United States Patent [19]

Edeus

[11] 4,081,880

[45] Apr. 4, 1978

[54] LOWER GUIDE FOR HORIZONTALLY SLIDING DOOR

[75] Inventor: James A. Edeus, Rock Falls, Ill.

[73] Assignee: National Manufacturing, Co., Sterling, Ill.

[21] Appl. No.: 740,254

[22] Filed: Nov. 10, 1976

[51] Int. Cl.[2] ..... A47H 15/00; E05D 13/02

[52] U.S. Cl. ..... 16/90; 16/87 R; 16/95 R

[58] Field of Search ..... 16/90, 87, 95, 94, 96; 49/409, 410, 411

[56] References Cited

U.S. PATENT DOCUMENTS

| | | | |
|---|---|---|---|
| 854,789 | 5/1907 | Woyak | 16/87 R |
| 2,023,873 | 12/1935 | DeHaven | 16/95 R |
| 2,893,069 | 7/1969 | Kessler | 16/94 X |
| 2,980,969 | 4/1961 | Tinfow | 49/411 |
| 3,345,677 | 10/1967 | Milette | 16/90 |
| 3,534,431 | 10/1970 | Uphoff | 49/410 |
| 3,855,732 | 12/1974 | Shear | 16/96 R |

FOREIGN PATENT DOCUMENTS

| | | | |
|---|---|---|---|
| 42,155 | 2/1969 | Germany | 49/410 |

*Primary Examiner*—Ronald Feldbaum
*Attorney, Agent, or Firm*—Edmond T. Patnaude

[57] ABSTRACT

A sliding door is suspended from a top rail for movement across a doorway and is guided at the bottom by a J-shaped rail mounted to the side of the building adjacent the doorway and extending upwardly into a downwardly opening channel provided along the bottom of the door.

8 Claims, 6 Drawing Figures

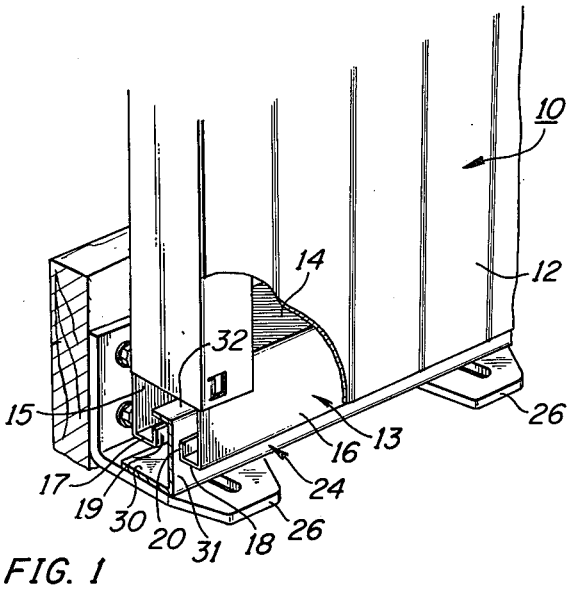
FIG. 1
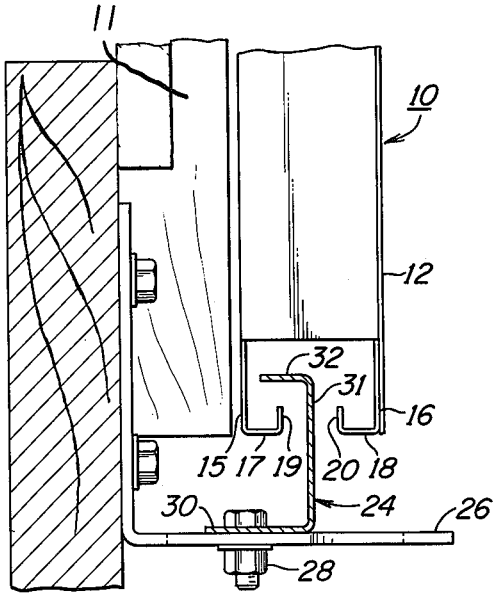
FIG. 2
FIG. 3
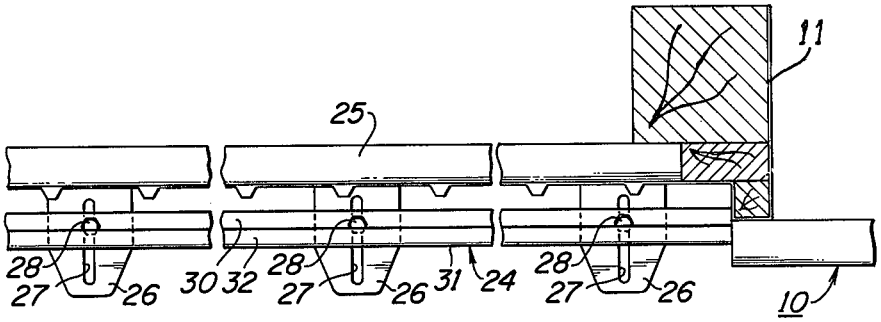
FIG. 4
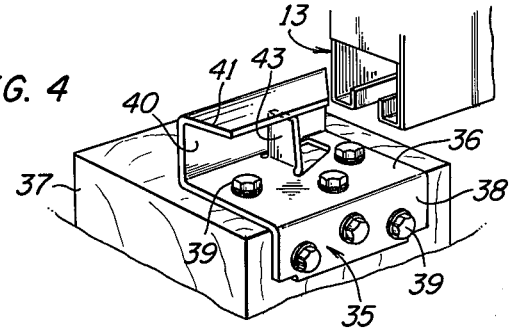
FIG. 5
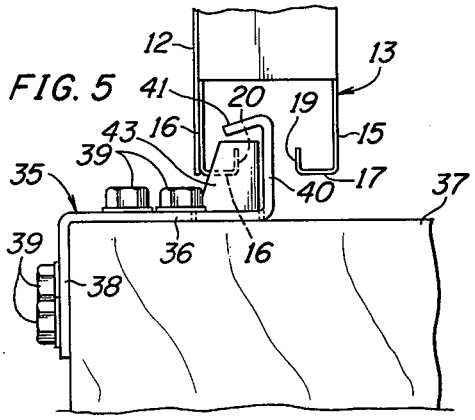
FIG. 6
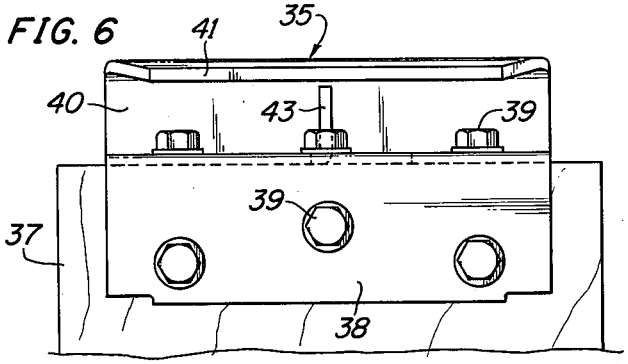

LOWER GUIDE FOR HORIZONTALLY SLIDING DOOR

The present invention relates in general to door guides and more particularly to a new and improved system for guiding the bottom edge of a top suspended horizontal sliding door.

BACKGROUND OF THE INVENTION

Storage buildings such as barns and the like commonly include horizontally sliding doors which are suspended by trolley hangars from a rail extending horizontally across the top of the associated doorway. In the so-called pole buildings there is no threshold which extends across the bottom of the doorway. Such a door is relatively large in cross-sectional area and unless it is held at the bottom it can be readily blown upwardly away from the building causing serious damage to the door system and oftentimes to the building itself.

SUMMARY OF THE INVENTION

Briefly there is provided in accordance with the present invention a new and improved lower guide system for suspended, horizontally slidable doors. This system includes two horizontally extending rails adjustably mounted to the building at respective sides of the doorway along the path of movement of the lower edge of the door. The door has a lower frame piece in the form of a downwardly open channel having horizontal reentrant flanges with upstanding vertical lips on the flanges. The guide rails each have an upstanding flange which extends into this door channel, and they further have a horizontal flange portion at the top of the flange overlying one of the vertical lips, whereby the rails prevent both outward and upward movement of the doors.

In order to hold the doors in place when they are in the closed position, a center door guide and stop is mounted at the bottom center of the doorway. The center door guide of this invention is a one-piece metal member having an upstanding flange with a bent over upper end portion for engaging the lower channel frame piece of the doors and it further includes a struck-out bent out portion which provides a center stop for both doors.

GENERAL DESCRIPTION OF THE DRAWING

Further objects and advantages and a better understanding of the present invention can be had by reference to the following detailed description, taken in connection with the accompanying drawing wherein:

FIG. 1 is a fragmentary perspective view showing the lower guide system of the present invention;

FIG. 2 is an elevational view of the system of FIG. 1 as viewed from the door jamb;

FIG. 3 is a fragmentary plan view of the lower guide system shown in FIGS. 1 and 2;

FIG. 4 is a perspective view particularly showing a center guide and door stop embodying the present invention;

FIG. 5 is a side elevation of the door stop of FIG. 4; and

FIG. 6 is a front elevation of the door stop of FIG. 4.

DETAILED DESCRIPTION OF THE INVENTION

Referring particularly to FIGS. 1–3, a door 10 is supported from the top for sliding horizontal movement past a door jamb 11 across a doorway, not completely shown. The door 10 includes a plurality of frame members to which panelling or siding 12 is fastened. The lower frame member of the door is a downwardly opening channel piece 13 having a horizontal web 14 and vertical side flanges 15 and 16. The lower ends of the side flanges are bent inwardly and upwardly to provide reentrant horizontal flanges 17 and 18 and upstanding lips 19 and 20. As shown, the ends of the channel member 13 are open at the vertical edges of the door.

In order to guide the bottom of the door and hold it in place against the building, there is provided in accordance with the present invention a guide system including a J-shaped guide rail 24 mounted to the side of the building 25 on a plurality of L-shaped brackets 26. The brackets 26 have mounting slots 27 receiving bolts 28 which extend through spaced mounting holes in the guide rail 24 to permit horizontal adjustment and alignment of the guide rail. The guide rail 24 is thus mounted along the path of movement of the door adjacent the doorway and to one side thereof. Ordinarily, two doors are mounted in biparting relationship, and a guide system including the rail and the mounting brackets is provided for each door. The guide rail 24 includes a horizontal base section 30 having an upstanding flange 31 at one side. The flange 31 extends upwardly between the lips 19 and 20 and has a laterally extending lip 32 extending across the top of the lip 19. As shown, the length of the lip 32 is slightly longer than the distance between the lips 19 and 20.

In order to hold the lower ends of the doors in place when the doors are in the fully closed position, there is provided a center guide and stop member 35 as illustrated in FIGS. 4, 5 and 6. The member 35 is a metal stamping having a planar horizontal portion 36 adapted to rest on a support such as the top of a pole 37 located at the center of the doorway. A depending flange 38 extends down over the front side of the pole, and a plurality of lag screws 39 secure the member 35 to the pole 37.

In order to guide the door into the center position, the guide member 35 has an upstanding flange 40 with an upper lip 41 extending downwardly at an angle of about sixteen degrees. As best shown in FIG. 5, the lip 41 extends over the top of the lip 19 on the door channel. A stop 43 in the form of a tongue is struck out of the plate portion 36 and bent upwardly at an angle of ninety-degrees so as to engage the end of the channel 13 when the door is moved into the central position. It will be understood that the second door engages the opposite side of the stop tongue 43 when it is in the closed position. The center guide and stop member 35 thus prevents both upward and lateral movements of the two doors and also provides a stop for locating the doors in the central closed positions.

While the present invention has been described in connection with particular embodiments thereof, it will be understood by those skilled in the art that many changes and modifications may be made without departing from the true spirit and scope of the present invention. Therefore, it is intended by the appended claims to cover all such changes and modifications which come within the true spirit and scope of this invention.

What is claimed is:

1. A lower guide for a pair of biparting sliding doors, comprising a member having a mounting plate portion adapted to be secured to a supporting surface said member having an upstanding flange the upper end portion of said flange being bent over to provide a laterally extending lip, and a stop extending laterally from said member adjacent said flange and below said lip.

2. A lower guide according to claim 1 wherein said stop is a bent over, integral portion of said member.

3. A lower guide according to claim 2 wherein said lip extends downwardly toward the plane of said plate portion.

4. A lower guide according to claim 3 wherein said flange extends upwardly from one edge of said plate portion.

5. In combination with a structure having an opening in a vertical side thereof, a door having a downwardly opening channel extending along the bottom thereof, said channel having first and second spaced apart coplanar horizontal reentrant flanges with a pair of vertical lips extending upwardly from the inner edges of said reentrant flanges, an elongated guide rail having a horizontal base flange, a vertical flange extending upwardly from one horizontal edge of said base flange, and an upper horizontal flange extending from the upper edge of said vertical flange in substantial parallelism with said base flange, a plurality of spaced apart bracket means secured to said structure and to said base flange for mounting said guide rail to said structure to one side of said opening, and said upper horizontal flange and an upper portion of said vertical flange being disposed within said channel with said upper horizontal flange overlying one of said lips to limit lateral and upward movement of said door.

6. The combination according to claim 5 wherein said bracket means each have a horizontally extending flange provided with an elongated slot extending perpendicularly to the path of movement of said door, said guide resting on said horizontally extending flanges, and a plurality of fastener means extending through the respective slots in said bracket means for fastening said rail to said horizontally extending flanges at an adjustable distance from said structure.

7. The combination according to claim 5 wherein said upper horizontal flange extends toward said structure from said vertical flange.

8. The combination according to claim 7 wherein the width of said upper horizontal flange is substantially less than the width of said base flange.

* * * * *